US008142167B2

(12) United States Patent
Vitale

(10) Patent No.: US 8,142,167 B2
(45) Date of Patent: Mar. 27, 2012

(54) PADDLEWHEEL APPARATUS

(76) Inventor: Robert Vitale, Franklin, NC (US)

( * ) Notice: Subject to any disclaimer, the term of this patent is extended or adjusted under 35 U.S.C. 154(b) by 481 days.

(21) Appl. No.: 12/402,001

(22) Filed: Mar. 11, 2009

(65) Prior Publication Data

US 2009/0232653 A1 Sep. 17, 2009

Related U.S. Application Data

(60) Provisional application No. 61/069,287, filed on Mar. 12, 2008.

(51) Int. Cl.
*F04B 49/00* (2006.01)

(52) U.S. Cl. ..... 417/14; 416/146 R

(58) Field of Classification Search ..... 416/36, 416/146 R; 417/14

See application file for complete search history.

(56) References Cited

U.S. PATENT DOCUMENTS

2007/0108768 A1* 5/2007 Dempster ..... 290/42

OTHER PUBLICATIONS

Putt, Algae as a Biodiesel Feedstock: A Feasibility Assessment, 2008, Auburn University.*

* cited by examiner

*Primary Examiner* — Bumsuk Won
*Assistant Examiner* — Brenitra Lee
(74) *Attorney, Agent, or Firm* — Shumaker, Loop & Kendrick, LLP

(57) ABSTRACT

A paddlewheel apparatus including a paddlewheel axle, first and second spaced apart annular wheel hubs locked in rotation with the axle, and a plurality of elongated tri-curved paddles cooperatively supported by the first and second wheel hubs and arranged around the circumference of the first and second annular wheel hubs and spaced apart from the paddlewheel axle. A method for creating current in a bio-pond raceway.

14 Claims, 5 Drawing Sheets

PADDLEWHEEL APPARATUS

CROSS-REFERENCE TO RELATED APPLICATION

This application claims priority to U.S. Provisional Application Ser. No. 61/069,287 filed Mar. 12, 2008.

FIELD OF THE INVENTION

The present invention relates generally to the field of paddlewheel apparatus for moving water, and more particularly, to a height-adjustable paddlewheel apparatus including a plurality of fixed, tri-curved paddles supported by at least one hub coupled to a motor driven shaft, wherein the paddle design provides improved rigidity, energy transfer and reduced drag as compared to conventional paddlewheel apparatus.

BACKGROUND OF THE INVENTION

Various species of algae are now being commercially grown for a variety of uses including bio-fuel feedstock and health supplements, among others. Algae are desirable in that they can be grown year round under the right temperature conditions, have relatively short generation times, and require readily available and inexpensive nutrients for growth, such as sunlight, water and carbon dioxide. Algae are also desirable in that they can be grown in adverse conditions, such as saline and brackish water.

Algae are typically grown in open bio-ponds and shallow raceways in which it is necessary to create a current to prevent the algae from becoming stagnant. It is also necessary to prevent algae from remaining at the surface of the pond in which sunlight exposure may be too great, or remaining at the bottom of the pond in which there is too little sunlight exposure, both of which are adverse to growth. Conventionally, to address these issues, paddlewheels have been deployed within ponds and raceways to introduce a current. These conventional paddlewheel designs, however, suffer from several disadvantages, some of which include utilizing large flat paddles that require large amounts of energy to move through the water, paddle structures that are cupped in the direction of rotation and retain water as the paddles leave the water, and paddlewheels that are fixed in height in relation to the pond floor, thus causing cavitation and the raising of liners in lined ponds.

Accordingly, to overcome the disadvantages of conventional paddlewheel designs, and to improve the creation of current in a bio-pond or raceway, a paddlewheel apparatus and methods of operation are provided that include an energy efficient paddle design, height adjustability, sensor control to optimize paddlewheel rotational speed and construction including materials adapted to withstand both fresh and salt water conditions.

BRIEF SUMMARY OF THE INVENTION

In one aspect, a paddlewheel apparatus is provided including a lightweight, energy efficient paddle design that reduces drag, increases the amount of water moved, and does collect water as the paddles leave the water.

In another aspect, a paddlewheel apparatus is provided including a control system that receives an input from a sensor module regarding at least one of liquid density and water current, and control the rotational speed of the paddlewheel based upon the output.

In yet another aspect, a paddlewheel apparatus is provided that is readily adjustable in height to accommodate various pond depths.

In yet another aspect, a paddlewheel apparatus is provided for creating and maintaining a current in a bio-pond or raceway.

To achieve the foregoing and other aspects and advantages of the present invention, in one embodiment a paddlewheel apparatus is provided including a paddlewheel axle, first and second spaced apart annular wheel hubs mechanically coupled to and locked in rotation with the paddlewheel axle, and a plurality of elongated, tri-curved paddles each being arranged generally parallel to a longitudinal axis of the paddlewheel axle and being cooperatively supported by the first and second wheel hubs, wherein the plurality of paddles are arranged at predetermined intervals around the circumference of the first and second annular wheel hubs and spaced apart from the paddlewheel axle.

Each of the tri-curved, also referred to herein as "Z-shaped," paddles is continuous and is bent or otherwise formed to define an inner paddle portion for providing rigidity to the paddle, a center paddle portion positioned at an angle with respect to the inner paddle portion for moving water, and an outer paddle portion positioned at an angle with respect to the center paddle portion for reducing paddle drag. The center and outer paddle portions together define a cup-shape that opens in the direction opposite the rotational direction of the paddlewheel apparatus so as not collect water therein as each paddle leaves the water. The first and second wheel hubs define slots in which the paddles are received and secured therein.

The paddlewheel apparatus further includes first and second fixed supports for supporting the paddlewheel axle and a motor coupled to the paddlewheel axle through a gearbox for rotating the paddlewheel axle. The apparatus further optionally includes a sensor module including at least one of a liquid density sensor and a water current sensor, and a motor speed regulator for receiving an output from the sensor module and regulating a voltage supplied to the motor to control the rotational speed of the paddlewheel axle in accordance with at least one of the liquid density and water current outputs.

In another embodiment, a paddlewheel apparatus is provided including a paddlewheel axle supported about each end by first and second fixed supports, first and second spaced apart annular wheel hubs mechanically coupled to and locked in rotation with the paddlewheel axle, a plurality of elongated Z-shaped paddles each cooperatively supported by the first and second wheel hubs, wherein the plurality of paddles are arranged at predetermined intervals around the circumference of the first and second annular wheel hubs and spaced apart from the paddlewheel axle, and a motor for rotating the paddlewheel axle.

In yet another embodiment, a method of creating current in a bio-pond is provided including providing a paddlewheel apparatus including a paddlewheel axle supported about each end by first and second fixed supports, first and second spaced apart annular wheel hubs mechanically coupled to and locked in rotation with the paddlewheel axle, a plurality of elongated Z-shaped paddles, a motor for rotating the paddlewheel axle through a gearbox, a sensor module including at least one of a liquid density sensor and a water current sensor, and a motor speed regulator for regulating the voltage supplied to the motor. The method further includes increasing or decreasing a rotational speed of the paddlewheel axle in response to the output of the sensor module by regulating the voltage supplied to the motor.

Additional features and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE FIGURES

These and other features, aspects and advantages of the present invention are better understood when the following detailed description of the invention is read with reference to the accompanying figures, in which.

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various figures.

Referring to the figures, various embodiments and deployments of an energy efficient paddlewheel apparatus are shown and described. The paddlewheel apparatus may be constructed from any materials, and is preferably constructed from lightweight materials adapted for long term use in both fresh water and saltwater applications without component degradation. Suitable paddlewheel material examples include, but are not limited to, stainless steel, fiberglass and aluminum. Various components of the apparatus may be mechanically coupled or fastened together using any number of conventional methods, and the specific methods described herein are not intended to limit the invention.

Figure 1:
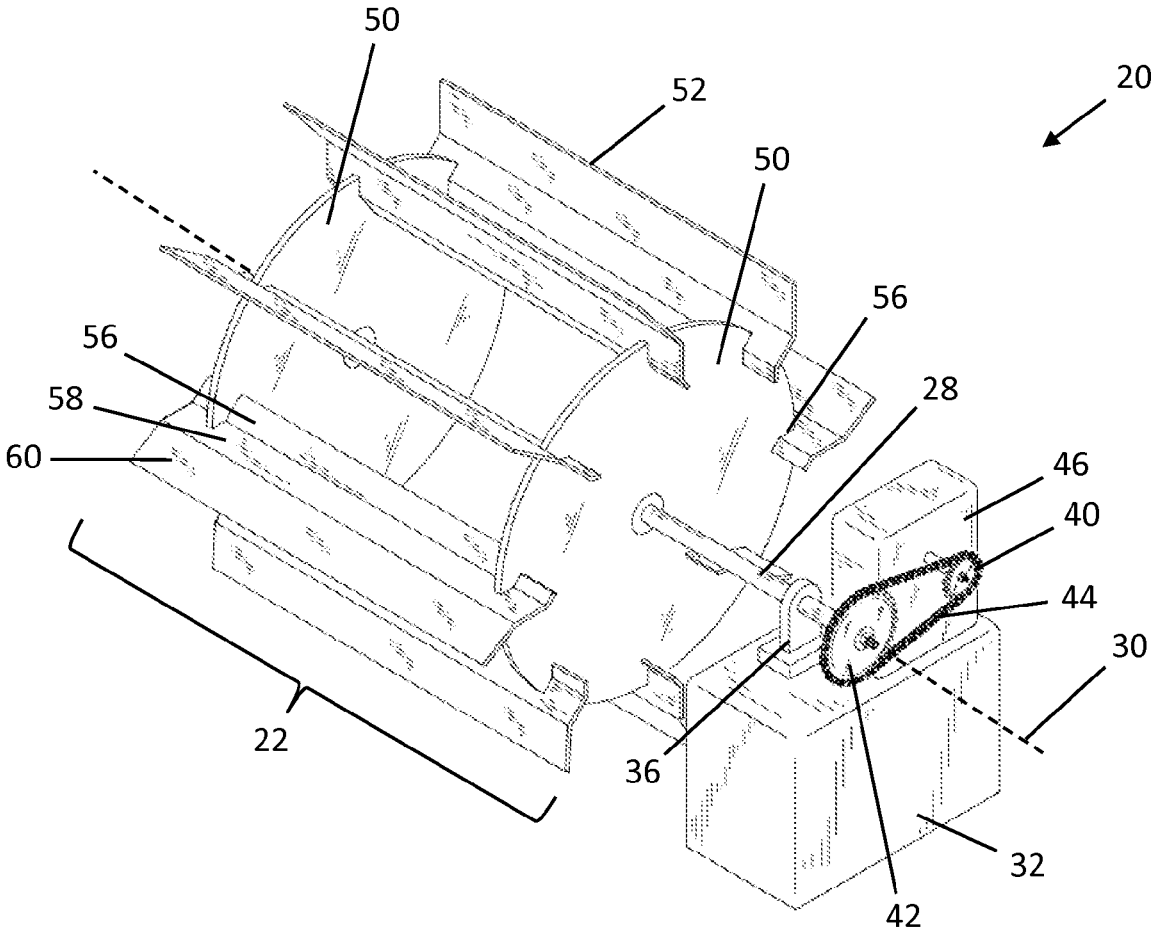
FIG. 1 is a perspective view of a paddlewheel apparatus in accordance with a preferred embodiment of the present invention.
Figure 2:
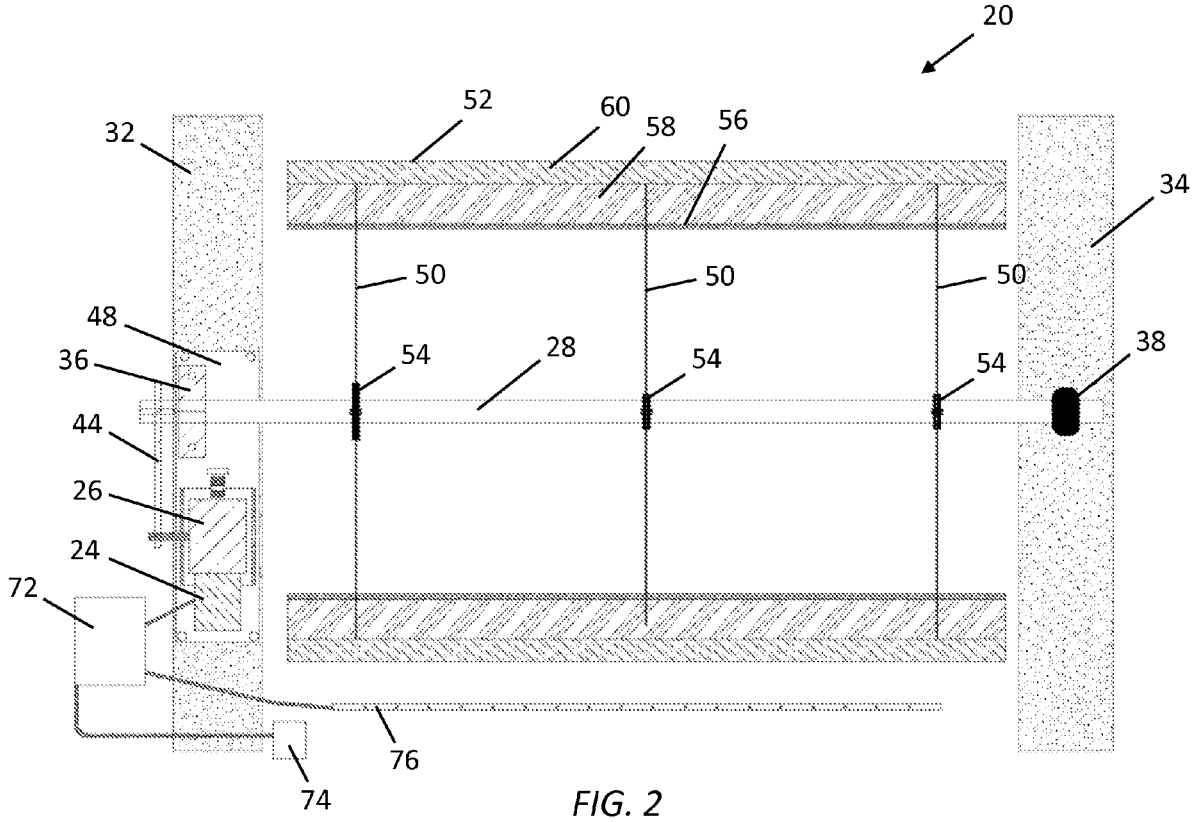
FIG. 2 is an overhead plan view of the paddlewheel apparatus including a sensor driven control system and carbon dioxide exhaust tube.

Referring to FIGS. 1-2, a paddlewheel apparatus is shown generally at reference numeral 20. The apparatus includes a paddlewheel 22 rotatably coupled to a drive motor 24 (shown schematically) through a gearbox 26. A paddlewheel axle 28 defines a longitudinal axis 30 about which the paddlewheel rotates. The paddlewheel axle 28 is supported about each of its ends by first and second fixed supports 32 and 34. As shown, the axle 28 is supported about each end by first and second axle bearings 36 and 38, which may be chosen for optimal low rotational friction and reduced wear. A sprocket 40 off the gearbox takeoff is attached to a sprocket 42 of larger diameter locked in rotation with and positioned about an end of the axle by a chain 44 to further reduce the overall rotational speed of the unit. The gearbox/motor, shown collectively as 46 in FIG. 1, and bearing 36, are supported on a mounting plate 48. Although not shown, bearing 38 may also be supported on a mounting plate as described in detail below.

The paddlewheel 22 further includes at least one annular wheel hub 50 for supporting a plurality of paddles 52. Referring specifically to FIG. 1, the apparatus includes a pair of spaced apart wheel hubs 50 for cooperatively supporting a plurality of paddles 52 about their ends. Referring specifically to FIG. 2, the apparatus includes three spaced apart wheel hubs 50 for cooperatively supporting a plurality of paddles 52 about their length. While at least one pair of wheel hubs 50 are preferred for providing stability to the paddles 52, the number of wheel hubs required for support corresponds to the length of the paddles 52. The wheel hubs 50 as shown are a single sheet of material, however in an alternative embodiment, may be made up of a plurality of spokes. The wheel hubs 50 are locked in rotation with the axle 28, and may be keyed to the axle 28 for alignment of the paddles 52. The wheel hubs 50 may be held in place utilizing axle locking set screw collars or locking rings 54 and a support flange alignment ring.

The wheel hubs 50 define slots 56 in which portions of the paddles 52 are received within and secured. The paddles 52 may be secured using any conventional fastener or by welding. Preferable fasteners are preferably low profile to reduce drag in the water. The paddles 52 are secured in predetermined intervals about the circumference of the wheel hubs with their longitudinal axis arranged generally parallel to the longitudinal axis 30 of the paddlewheel axle 28, and with the general lateral axis arranged generally perpendicular to a tangent of the wheel hub. The paddles preferably define a width less than the radius of the wheel hubs 50, and thus are spaced apart from the paddlewheel axle 28 providing an internal material void in the paddle to reduce rotational mass, prevent the paddles from collecting water and reducing materials.

Each paddle 52 is elongated and tri-curved, also referred to herein as "Z-shaped," and is preferably constructed from a continuous piece of material bent, formed or molded to define the proper shape. Each paddle 52 defines an inner paddle portion 56 positioned closest to the axle 28 for providing rigidity to the paddle, a center paddle portion 58 positioned at an angle with respect to the inner paddle portion 56 for moving water, and an outer paddle portion 60 positioned furthest from the axle 28 and at an angle with respect to the center paddle portion 58 for reducing paddle drag.

The tri-curve paddle 52 is specifically designed for moving algae in culturing ponds. The inner paddle portion 56 is designed to add rigidity to the paddle 52 allowing a small amount of paddle area while the bend increases the structural support allowing for fewer wheel hub support sections along long paddle length distances. The center paddle portion 58 is the key water moving section of the paddle 52. The outer paddle portion 60 transfers the final energy of the sweep of the paddle 52 in the pond to continue along its final path. Thus, the paddle shape aids in energy transfer, unlike conventional flat or cupped paddles in which the final sweep of the paddle creates a drag on the system and a load on the motor.

Figure 4:
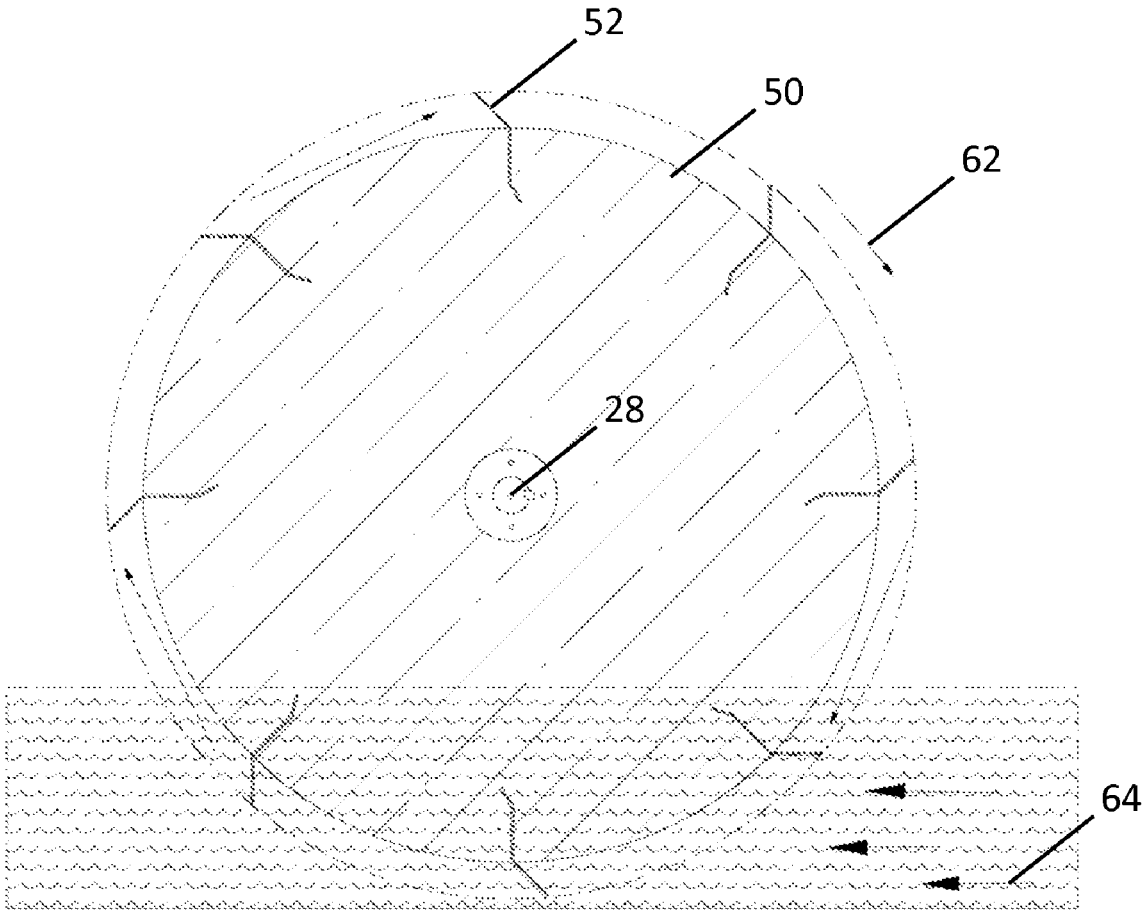
FIG. 4 is a sectional view of the paddlewheel portion of the apparatus shown deployed within a body of water to indicate the direction of rotation.

Referring to FIG. 4, a sectional view of the paddlewheel portion of the apparatus is shown deployed within a body of water to indicate the rotational direction of the paddlewheel, indicated by arrows 62. The center and outer paddle portions 58 and 60 together define a cup-shape that opens in the direction opposite the direction of rotation 62 and current 64. As compared with conventional paddlewheels, the direction of opening of the cup shape prevents the paddle 52 from collecting water as the paddles leave the water. This is further advantageous in that the shape prevents algae clusters from being picked up as the paddles travels along their circular path.

Figure 3:
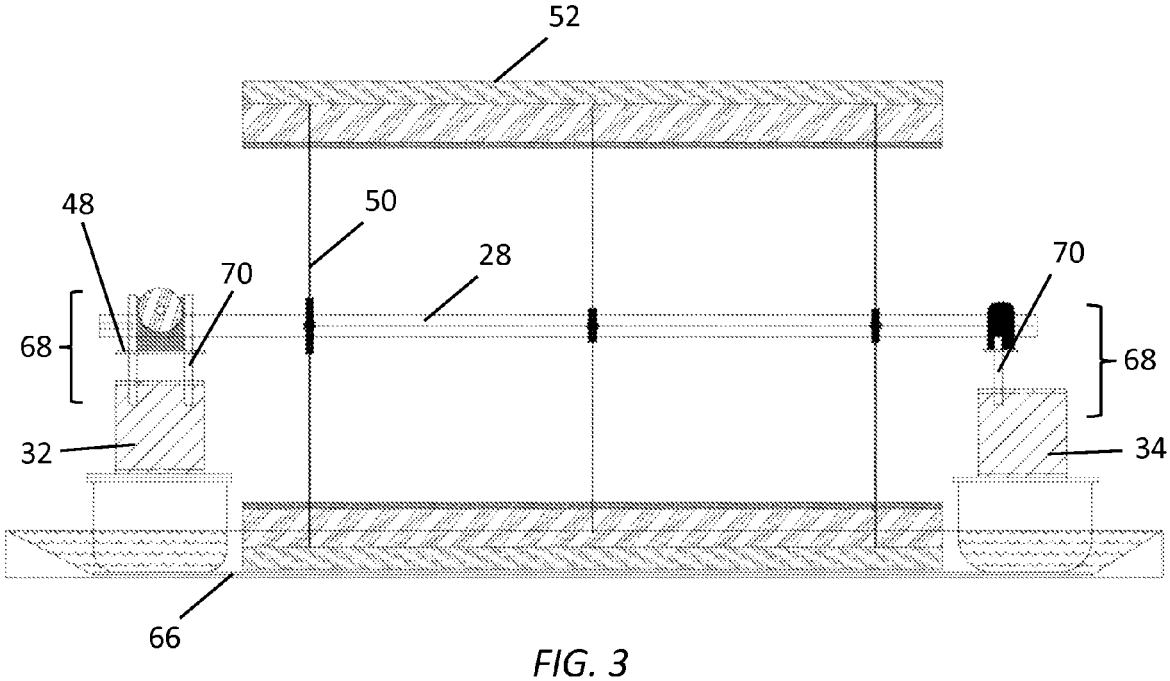
FIG. 3 is a front elevation view of the paddlewheel apparatus shown deployed within a body of water.

Referring to FIG. 3, the paddlewheel apparatus is shown deployed within a pond or raceway. First and second supports 32 and 34 are fixed in position about each end of the axle 28 on the pond floor 66. Two supports are shown with an upper support bracket supporting the motor/gearbox 46 and bearings 36. Suitable examples of supports include, but are not limited to, pontoons, structural metal, fiberglass and concrete. Supports may be permanent of removable. The apparatus may include additional bracing.

The apparatus further includes a height adjustment mechanism including holes defined through the mounting plate 48 for allowing threaded rods 70 to pass therethrough. Thus, the threaded rods 70 are secured about one end to the axle 28, and secured about their other end to the supports 32 and 34. The height adjustment mechanism may include a simple nut and bolt locking arrangement on the threaded rod to the gearbox/motor mounting plate 48, and the paddlewheel portion has the ability to be raised and lowered to adjust the position of the paddles 52 with respect to the pond floor 66. The motor/gearbox unit 46 is preferably positioned above the surface of the water. The ability to raise or lower the paddles 52 in relation to the pond floor is important for efficient water flow, minimizing cavitation, and creating a non-turbuent mixing. Further, in applications including a pond liner, the ability to position the paddles away from the liner prevents it from being pulled up.

Referring again to FIG. 2, the paddlewheel apparatus further includes a motor speed regulator 72 in communication with a sensor module 74. The motor speed regulator 72 is electrically coupled with the motor 24 and is operable for receiving an output from the sensor module 74 and controlling the voltage supplied to the motor to adjust the rotational speed of the paddlewheel based on the sensor module output. The sensor module includes at least one of a liquid density sensor and a water current sensor positioned within the water. The sensors are operable for monitoring the liquid density and water current and adjusting the rotational speed of the paddlewheel according to a predetermined set of instructions.

In operation, the motor speed regulator 72 is set to a predetermined pond current water velocity for the given growth cycle of an algae species. The motor speed regulator 72 maintains the current speed by a variety of measurements including monitoring the density of the water (i.e., the level of growth of the algae strands), and water current speed. This information is used to determine the correct rotational speed of the paddles. Less energy is required when the water density is low and the current high.

The paddlewheel apparatus further optionally includes a carbon dioxide exhaust tube 76 for injecting carbon dioxide into the water to saturate the water with gas. The tube 76 is preferably mounted along the front edge of the water entry side onto the paddlewheel support structure. The length of the tube 76 corresponds to the length of the paddles 52. The placement of the injection tube 76 at the paddle entry point optimizes the infusion of carbon dioxide into the algae water. Carbon dioxide is a key feedstock nutrient to promote the growth of algae. Normal air absorption by algae from the air is about 2%. This method of injection of carbon dioxide into the water increases the absorption rate by 5 fold, taking advantage of the water cavitation effect created as the paddles 52 move the water.

Figure 5:
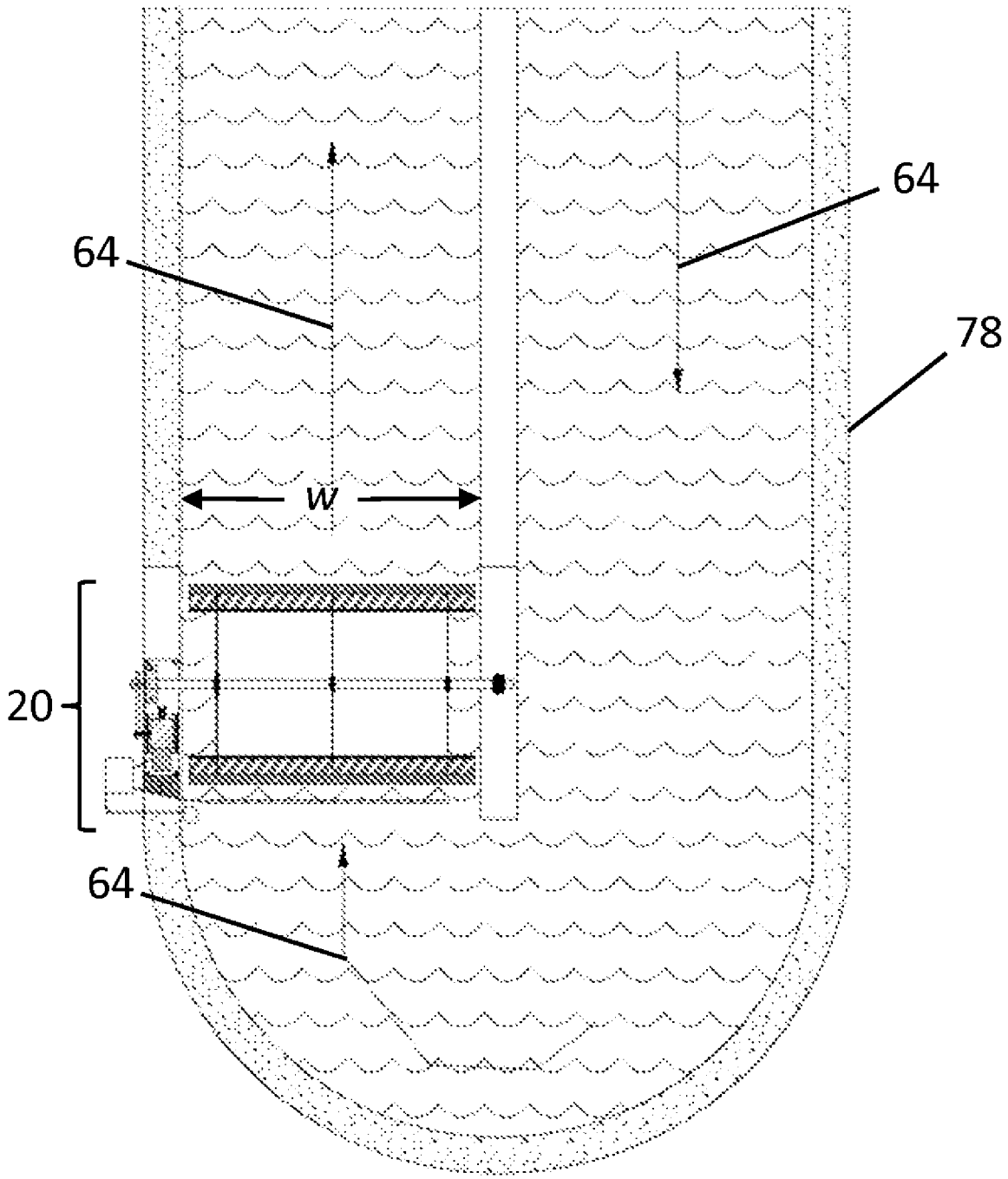
FIG. 5 is an overhead plan view of the paddlewheel apparatus deployed within a bio-pond raceway.

Referring to FIG. 5, the paddlewheel apparatus 20 is shown deployed within a raceway 78. The length of the paddles 52 generally corresponds to the width w of the raceway 78. Current direction is indicated by arrows 64. The paddlewheel apparatus is customized to operate in a designated space for the purpose of growing high-density bio-masses of algae. The paddlewheel apparatus is designed to provide a constant flow of the water containing the algae. The water current or velocity in the raceway is predetermined based upon a variety of factors including, but not limited to, the depth of the raceway and the algae species being cultivated. As stated above, the sensor module 74 outputs sensor readings to the motor speed regulator 72 to increase or decrease motor speed depending upon the density of the algae clusters and/or water current.

In response to the output of the motor speed regulator 72, the motor 24, preferably an electric motor known to those skilled in the art, turns the reduction gearbox 26, which in turn rotates the paddlewheel axle 28 and paddles 52. The paddlewheel apparatus works on the principle of pushing the water along the raceway 78 by the force of the tri-curved paddles 52 sweeping across the entire width w of the shallow water in the pond. The diameter of the paddlewheel, the number of paddles, and the required speed of the rotation of the paddles is determined by the specific strand of algae being grown, the height of the water that holds the algae, and the support wall or brim height to insure the motor and gear box are above the flood plane of the pond. No set hub diameter, number of hubs, number of paddles or the overall dimensions of the tri-curve paddle length or width for the are defined for this reason.

While a paddlewheel apparatus has been described with reference to specific embodiments and examples, it is envisioned that various details of the invention may be changed without departing from the scope of the invention. Furthermore, the foregoing description of the preferred embodiments of the invention and best mode for practicing the invention are provided for the purpose of illustration only and not for the purpose of limitation.

What is claimed is:

1. A paddlewheel apparatus, comprising:

a paddlewheel axle;

first and second spaced apart annular wheel hubs mechanically coupled to and locked in rotation with the paddlewheel axle;

a plurality of elongated, tri-curved paddles each being arranged generally parallel to a longitudinal axis of the paddlewheel axle and being cooperatively supported by the first and second wheel hubs, wherein the plurality of paddles are arranged at predetermined intervals around the circumference of the first and second annular wheel hubs and spaced apart from the paddlewheel axle;

first and second fixed supports supporting the paddlewheel axle; and a motor coupled to the paddlewheel axle through a gearbox for rotating the paddlewheel axle;

wherein the paddlewheel axle is mechanically coupled to the first and second supports through a height-adjustment mechanism for adjusting the height of the paddlewheel axle with respect to a pond floor.

2. The paddlewheel apparatus in accordance with claim 1, wherein each of the tri-curved paddles is continuous and comprises:

an inner paddle portion for providing rigidity to the paddle;

a center paddle portion positioned at an angle with respect to the inner paddle portion for moving water; and an outer paddle portion positioned at an angle with respect to the center paddle portion for reducing paddle drag.

3. The paddlewheel apparatus in accordance with claim 2, wherein the center and outer paddle portions together define a cup-shape that opens in the direction opposite a rotational direction of the paddlewheel apparatus so as not collect water therein as each paddle leaves the water.

4. The paddlewheel apparatus in accordance with claim 1, wherein each of the paddles is Z-shaped.

5. The paddlewheel apparatus in accordance with claim 1, wherein the first and second wheel hubs define slots in which the paddles are received and secured.

6. The paddlewheel apparatus in accordance with claim 1, further comprising:

a sensor module including at least one of a liquid density sensor and a water current sensor; and a motor speed regulator for receiving an output from the sensor module and regulating a voltage supplied to the motor to control the rotational speed of the paddlewheel axle in accordance with at least one of liquid density and water current.

7. The paddlewheel apparatus in accordance with claim 1, further comprising a carbon dioxide exhaust tube positioned to deliver carbon dioxide to algae in a body of water in which the paddlewheel apparatus is deployed.

8. The paddlewheel apparatus in accordance with claim 1, wherein the paddlewheel apparatus is deployed within a bio-pond raceway.

9. A paddlewheel apparatus, comprising:

a paddlewheel axle supported about each end by first and second fixed supports;

first and second spaced apart annular wheel hubs mechanically coupled to and locked in rotation with the paddlewheel axle;

a plurality of elongated Z-shaped paddles each cooperatively supported by the first and second wheel hubs, wherein the plurality of paddles are arranged at predetermined intervals around the circumference of the first and second annular wheel hubs and spaced apart from the paddlewheel axle;

a motor for rotating the paddlewheel axle; and a height-adjustment mechanism for adjusting the height of the paddlewheel apparatus with respect to a pond floor.

10. The paddlewheel apparatus in accordance with claim 9, wherein each of the paddles is continuous and comprises:

an inner paddle portion for providing rigidity to the paddle;

a center paddle portion positioned at an angle with respect to the inner paddle portion for moving water; and an outer paddle portion positioned at an angle with respect to the center paddle portion for reducing paddle drag.

11. The paddlewheel apparatus in accordance with claim 10, wherein the center and outer paddle portions together define a cup-shape that opens in the direction opposite a rotational direction of the paddlewheel apparatus so as not collect water therein as each paddle leaves the water.

12. The paddlewheel apparatus in accordance with claim 9, further comprising:

a sensor module including at least one of a liquid density sensor and a water current sensor; and a motor speed regulator for receiving an output from the sensor module and regulating a voltage supplied to the motor to control the rotational speed of the paddlewheel axle.

13. The paddlewheel apparatus in accordance with claim 9, further comprising a carbon dioxide exhaust tube for delivering carbon dioxide to a body of water in which the paddlewheel apparatus is deployed.

14. The paddlewheel apparatus in accordance with claim 9, wherein the paddlewheel apparatus is deployed within a bio-pond raceway.

* * * * *